US006436479B2

(12) United States Patent
Takahashi et al.

(10) Patent No.: US 6,436,479 B2
(45) Date of Patent: Aug. 20, 2002

(54) SOLUTION FOR FORMING NICKEL METAL THIN FILM AND METHOD OF FORMING NICKEL METAL THIN FILM USING THE SAID SOLUTION

(75) Inventors: Yasutaka Takahashi; Yutaka Ohya; Takayuki Ban, all of Gifu (JP)

(73) Assignee: President of Gifu University, Gifu (JP)

( * ) Notice: Subject to any disclaimer, the term of this patent is extended or adjusted under 35 U.S.C. 154(b) by 0 days.

(21) Appl. No.: 09/734,603

(22) Filed: Dec. 13, 2000

(30) Foreign Application Priority Data

Jan. 17, 2000 (JP) ..... 2000-007868

(51) Int. Cl.[7] ..... B05D 3/12; B05D 1/18; B05D 3/02; C09D 5/00

(52) U.S. Cl. ..... 427/443.2; 427/126.6; 427/240; 427/376.6; 427/376.7; 427/383.1; 106/1.21; 106/1.27

(58) Field of Search ..... 427/126.6, 240, 427/443.2, 376.6, 376.7, 383.1; 106/1.21, 1.22, 1.24, 1.27

(56) References Cited

U.S. PATENT DOCUMENTS

| | | | | |
|---|---|---|---|---|
| 3,674,517 A | | 7/1972 | Miller | |
| 4,695,489 A | | 9/1987 | Zarnoch et al. | |
| 4,780,342 A | * | 10/1988 | LeBlanc, Jr. | 427/443.1 |

FOREIGN PATENT DOCUMENTS

| | | | |
|---|---|---|---|
| EP | 0 084 300 | | 7/1983 |
| GB | 1 339 829 | | 12/1973 |
| JP | 60-249141 A | * | 12/1985 |

* cited by examiner

*Primary Examiner*—Michael Barr
(74) *Attorney, Agent, or Firm*—Oblon, Spivak, McClelland, Maier & Neustadt, P.C.

(57) ABSTRACT

Disclosed is a method of forming a nickel metal thin film, comprising the steps of coating a substrate with a solution for forming a nickel metal thin film, the solution being formed of an alcohol solution containing nickel ions and a reducible chelate type ligand having a hydrazone unit so as to form a gel film, and subjecting the resultant gel film to a heat treatment under an inert gas atmosphere.

16 Claims, 1 Drawing Sheet

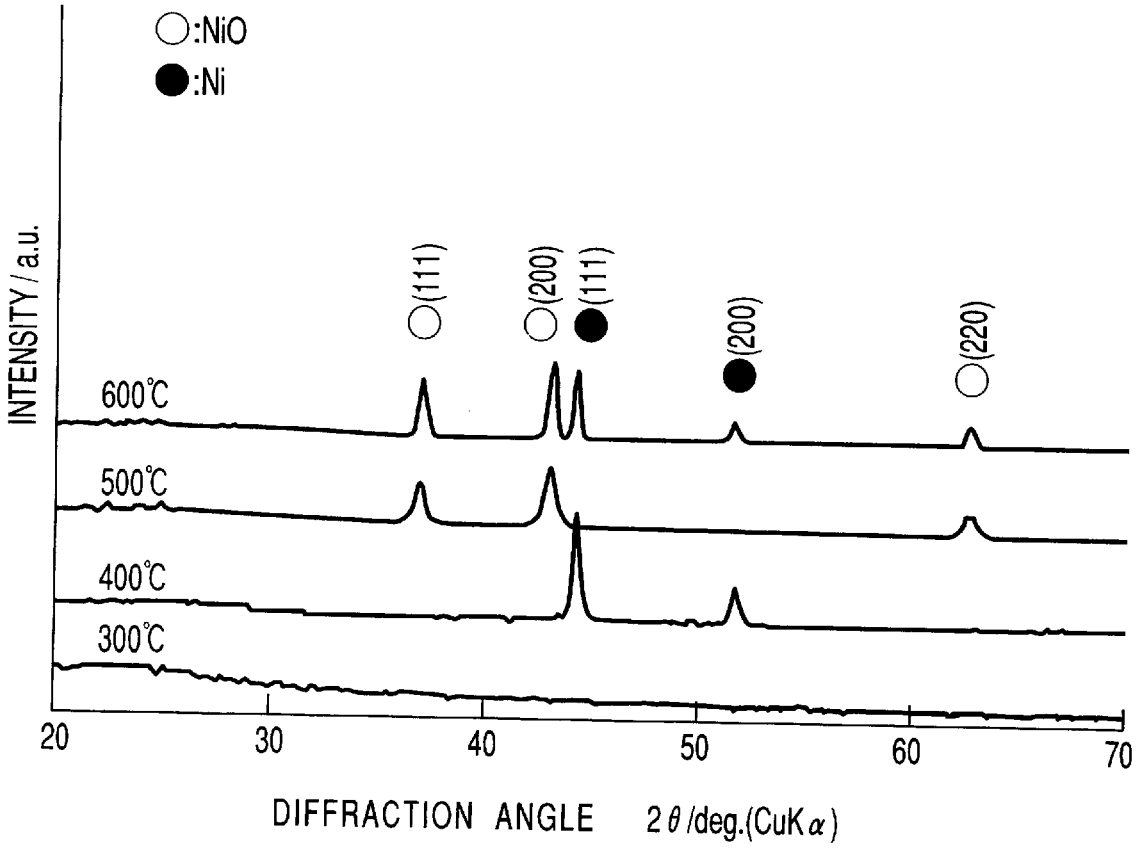
FIGURE

SOLUTION FOR FORMING NICKEL METAL THIN FILM AND METHOD OF FORMING NICKEL METAL THIN FILM USING THE SAID SOLUTION

CROSS-REFERENCE TO RELATED APPLICATIONS

This application is based upon and claims the benefit of priority from the prior Japanese Patent Application No. 2000-007868, filed Jan. 17, 2000, the entire contents of which are incorporated herein by reference.

BACKGROUND OF THE INVENTION

The present invention relates to a metal solution used as a raw material for forming a nickel metal thin film directly on a substrate and to a method of forming a nickel metal thin film using the said metal solution.

A nickel metal thin film is formed in general by, for example, an electroplating method, a chemical plating method, a printing method or a vapor deposition method.

The most general process of synthesizing a nickel metal film is an electrolytic process. In the case of employing the electrolytic process, however, the coating substrate is limited to a conductive substrate. On the other hand, an electroless plating makes it possible to apply coating of a metal film to an insulating substrate. However, it is difficult to control the thickness of the coated film. In addition, since hypophosphorous acid is used as a raw material, the resultant nickel metal film is caused to contain phosphorus as an impurity.

It is also possible to utilize a screen printing method using a metal paste containing a metal powder as a main component. In this case, however, it is difficult to use a fine nickel metal powder.

Further, it is known that in this process a nickel oxide film is formed first, followed by reducing the nickel oxide film with hydrogen so as to convert the oxide film into a nickel metal film. However, a reducing atmosphere is utilized in this method, which provides a serious obstacle in terms of the film forming cost and the film forming process. In addition, the nickel film thus formed is porous.

BRIEF SUMMARY OF THE INVENTION

An object of the present invention is to provide a solution for forming a nickel metal thin film, which is used as a raw material solution for forming a high purity nickel metal thin film directly on a substrate by a simple process.

Another object of the present invention is to provide a method of forming a high purity nickel metal thin film directly on a substrate by a simple process and with a low cost.

According to a first aspect of the present invention, there is provided a solution for forming a nickel metal thin film, the solution being formed of an alcohol solution containing nickel ions and a reducible chelate type ligand having a hydrazone unit.

According to a second aspect of the present invention, there is provided a method of forming a nickel metal thin film, comprising the steps of:

coating a substrate with a solution for forming a nickel metal thin film, the solution being formed of an alcohol solution containing nickel ions and a reducible chelate type ligand having a hydrazone unit so as to form a gel film; and subjecting the resultant gel film to a heat treatment under an inert gas atmosphere.

Further, according to a third aspect of the present invention, there is provided a method of forming a nickel metal thin film, comprising the steps of:

coating a substrate with a solution for forming a nickel metal thin film, the solution being formed of an alcohol solution containing a reducible chelate type ligand having a hydrazone unit and nickel ions, the reducible chelate type ligand being contained in an amount two times as much in the molar amount as the nickel ions, so as to form a gel film; and subjecting the resultant gel film to a heat treatment under an inert gas atmosphere.

In the solution of the present invention for forming a nickel metal thin film, it is desirable for the reducible ligand to be contained in an amount two times as much in the molar amount as the nickel ions.

In the method of the present invention for forming a nickel metal thin film, the substrate can be coated with the solution for forming the nickel metal thin film by means of a dip coating method or a spin coating method.

Also, it is desirable for the heat treatment to be carried out at temperatures not lower than 400° C. for 10 to 30 minutes.

Further, an insulating substrate can be used as the substrate on which the nickel metal thin film is formed.

Additional objects and advantages of the invention are given in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

The single FIGURE is a chart showing the dependence of the XRD pattern of a nickel metal thin film on the heat treating temperature.

DETAILED DESCRIPTION OF THE INVENTION

The present invention will now be described in detail.

The present inventors have found that α-hydroxy ketone hydrazone produces a strongly promotes the dissolution of a metal acetate in alcohol. Since hydrazone contains a hydrazine unit effective as a reducing agent, the particular effect can be positively utilized. The present invention has been achieved on the basis of the particular finding.

The solution of the present invention for forming a nickel metal thin film can be prepared by dissolving, for example, a compound capable of forming a reducible chelate type ligand and a nickel metal raw material in alcohol used as a solvent.

It is desirable to use a hydrazone derivative R(R')C=$NNH_2$, where each of R and R' represents, for example, a substituted or unsubstituted alkyl group, as the reducible ligand. The chelate type compound having the particular structural unit includes, for example, hydroxy ketone hydrazone and diketone hydrazone. Each of hydroxy ketone hydrazone and diketone hydrazone has as a skeletal structure a hydroxyl group or a carbonyl group and a C═N group capable of chelate coordination with a metal and, thus, can be strongly coordinated with the metal. To be more specific, the hydroxy ketone hydrazone and diketone hydrazone used in the present invention, for example, include acetal hydrazone synthesized from acetal and hydrazine and diketone hydrazone synthesized from diacetyl and hydrazine.

Alternatively, it is possible to use a mixture of hydroxy ketones including acetyl ketone, diketones and hydrazine hydrate in place of hydrazone. The hydroxy ketones used in the present invention include, for example, α-hydroxy ketones such as acetol, acetoin, and benzoin, and β-hydroxy ketones such as γ-keto butanol. On the other hand, the diketones used in the present invention include, for example, diacetyl and benzyl.

In the case of using the hydrazone described above, it is desirable for the hydrazone content of the solution to be two times as much in the molar amount as the content of the nickel ions. Also, in the case of using a mixture of hydroxy ketones, diketones and hydrazine hydrate, it is desirable for the content of each of these components to be two times as much in the molar amount as the content of the nickel ions. If the amount of hydrazone or the like is smaller than two times as much as that of the nickel ions, the solution tends to be made unstable so as to be gelled. In this case, it is difficult to carry out the film coating.

Various inorganic metal salts can be used as the nickel metal raw material, though it is desirable for the nickel metal raw material not to contain a harmful element such as halogen or sulfur in view of the synthesizing process of the metal film. Particularly, it is most desirable to use nickel acetate in order to prevent generation of a corrosive gas in the step of the thermal decomposition.

The alcohol used in the present invention includes, for example, methanol, ethanol, isopropanol, n-butanol, isobutanol, sec-butanol, methoxy ethanol, and ethoxy ethanol.

The solution of the present invention for forming a nickel metal thin film can be prepared by suspending nickel acetate used as a nickel metal raw material in, for example, an alcohol, followed by adding a predetermined amount of hydrazone to the suspension. Alternatively, it can be prepared by adding a mixture of nickel acetate, hydroxy ketone (or diketone) and hydrazine hydrate mixed at a mixing ratio (molar ratio) of 1:2:2 to an alcohol.

A nickel metal thin film can be formed directly on a substrate by using the resultant solution for forming a nickel metal thin film by the method described below.

In the first step, the substrate is coated with the solution by a dip coating method or a spin coating method so as to form a gel film. It is possible to use an insulating substrate such as a glass substrate or a ceramic substrate. Also, it is possible to apply a surface treatment to the insulating substrate, as required. The surface treatment includes, for example, coating of an oxide such as titania by utilizing a sol-gel method.

In the next step, the gel film is dried under the air atmosphere at 100 to 120° C., followed by applying a heat treatment to the dried film under an inert gas atmosphere such as a nitrogen gas atmosphere so as to form a nickel metal film. It is desirable to apply the heat treatment under the temperature not lower than 400° C. for 10 to 30 minutes. Where the temperature for the heat treatment is lower than 400° C., it is difficult to form a complete metal film. Also, where the heat treating time is shorter than 10 minutes, the nickel-forming reaction is rendered incomplete. On the other hand, if the heat treating time exceeds 30 minutes, nickel oxide tends to be formed by the influence of the water or oxygen contained in the gas. Incidentally, the upper limit of the heat treating temperature is not particularly specified in the present invention. However, it is desirable to set the upper limit of the heat treating temperature at about 600° C. in order to prevent nickel from being oxidized by the oxygen component contained in the atmosphere.

As described above, the present invention makes it possible to form a nickel metal film of a high purity directly on an insulating substrate by a so-called "thermal decomposition method of a coated film".

Also, it is possible to further improve the bonding strength between the nickel metal thin film and the substrate and to further improve the uniformity of the metal thin film by employing a $TiO_2$ pre-coating method. Incidentally, the $TiO_2$ pre-coating method represents a so-called sol-gel method, in which coating is performed by utilizing a sol obtained from titanium alkoxide by a dip coating method.

It is also possible to control the thickness of the resultant nickel metal thin film by repeating the above-described steps of the gel film deposition, the drying and the heat treatment.

The present invention will now be described more in detail with reference to specific examples.

Specifically, a solution of the present invention for forming a nickel metal thin film was prepared as follows by utilizing the in-situ reaction given below between acetol and hydrazine:

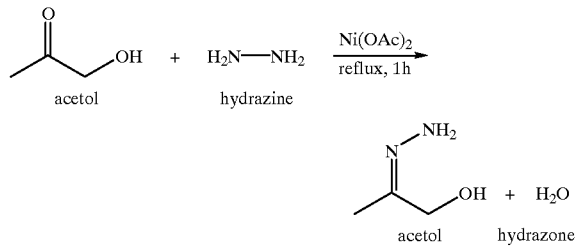

To be more specific, acetol and hydrazine were dissolved in a 2-propanol solvent at room temperature, and the resultant solution was kept stirred for not shorter than 5 hours. The solution thus prepared was left to stand. Then, $Ni(OAc)_2 \cdot 4H_2O$ used as the nickel metal raw material was added to the solution and the resultant solution was stirred, followed by subjecting the solution to reflux for one hour so as to obtain a solution of the present invention for forming a nickel metal thin film. The molar ratio R of each of acetol and hydrazine to the nickel metal raw material was set at 2. The Ni atom concentration in the resultant solution was found to be 0.5M.

Then, the surface of a heat resistant glass (Corning #7059) used as a substrate was coated with the resultant solution by a dip coating method so as to form a gel film. In this step, the pull-up rate of the substrate was set at 6 cm/min. The resultant gel film was dried at 110° C. for 10 minutes, followed by applying a heat treatment to the dried film at 400 to 600° C. for 30 minutes under a nitrogen gas atmosphere.

The steps of the coating, drying and heat treatment described above were repeated 5 times so as to form a nickel metal thin film on the substrate. The thin film thus formed was found to have a thickness of about 80 nm.

Further, several kinds of metal solutions were prepared as above, except that the kinds, the molar ratios, etc. of the compounds used were changed, and it was attempted to form thin films.

The solubility of $Ni(OAc)_2 \cdot 4H_2O$ in each of the solutions was visually observed, and the state of the formed thin film was observed by X-ray diffractometry. Table 1 shows the results.

TABLE 1

| Additives | R | Solubility | Formed phase |
|---|---|---|---|
| Acetol-hydrazine | 2 | ○ | Ni |
| Acetol-hydrazine | 1 | ○ | NiO |
| Hydrazine | 2 | X | — |
| Acetol | 2 | ○ | NiO |
| Acetoin | 2 | X | — |
| Acetoin-hydrazine | 1 | Δ | NiO |
| Acetoin-hydrazine | 2 | ○ | NiO |

○: Dissolved Δ: Precipitation X: Insoluble

As shown in Table 1, the acetol-hydrazine mixture (R=2), which performs a highly effective function of a reducing agent, permits forming a nickel metal thin film. The effect of the mixed system is based on the hydrazone formation shown in the reaction formula given previously and on the coordination of the compounds with nickel given by the chemical formula given below:

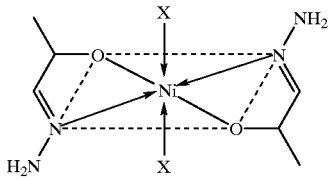

"X" included in the chemical formula given above represents the solvent.

Incidentally, each of hydrazine and hydroxy ketone does not perform the function of a reducing agent when used singly, as apparent from Table 1.

The accompanying FIGURE shows the dependence of the XRD pattern of the nickel metal thin film formed by the method of the present invention on the temperature for the heat treatment. As apparent from FIGURE, a nickel metal thin film of the highest purity can be obtained in the case where the heat treatment is carried out at 400° C.

The thickness and the resistivity of the nickel metal thin film formed by the method of the present invention were measured, with the results as shown in Table 2. In this case, the bonding strength between the nickel metal thin film and the substrate was further improved by employing the $TiO_2$ pre-coating method described previously. Incidentally, Table 2 also shows the results in respect of the nickel thin film obtained by the conventional two stage method (method of reducing nickel oxide with hydrogen) and the results in respect of the pure nickel taken from literature (Chemical Dictionary, Tokyo Kagaku Dojin).

TABLE 2

| Substance | Film thickness (nm) | Resistivity ($\Omega \cdot cm^2$) |
|---|---|---|
| Present invention | 80 | $2.0 \times 10^{-5}$ |
| Nickel film converted from NiO | 200 | $1.5 \times 10^{-5}$ |
| Pure nickel | — | $6.9 \times 10^{-6}$ |

Taken from literature (Chemical Dictionary, Tokyo Kagaku Dojin)

As apparent from Table 2, the nickel metal thin film formed by the method of the present invention, which has a resistivity substantially equal to that of the nickel thin film formed by the conventional two stage method, has a resistivity about twice as high as that of the pure nickel.

To reiterate, in the method of the present invention, a substrate is coated with a solution containing a reducible ligand and nickel ions so as to form a gel film, followed by applying a heat treatment to the gel film under an inert gas atmosphere such as a nitrogen gas atmosphere. The particular method of the present invention makes it possible to form a nickel metal thin film of a high purity directly on a substrate.

As described above in detail, the present invention provides a solution for forming a nickel metal thin film, said solution providing a raw material solution for forming a nickel metal thin film of a high purity directly on a substrate by a simple process. The present invention also provides a method of forming a nickel metal thin film of a high purity directly on a substrate by a simple process with a low cost.

The present invention, which has made it possible to form a high quality nickel metal thin film directly even on a substrate that does not exhibit conductivity, has a very high industrial value.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A solution for forming a nickel metal thin film having a thickness of about 80 nm or less, said solution being formed of an alcohol solution containing nickel ions and a reducible chelating ligand having a hydrazone unit.

2. The solution for forming a nickel metal thin film according to claim 1, wherein said reducible chelating ligand is contained in said solution in a molar amount two times as large as said nickel ions.

3. A method of forming a nickel metal thin film having a thickness of about 80 nm or less, comprising the steps of:

coating a substrate with a solution for forming a nickel metal thin film having a thickness of about 80 nm or less, said solution being formed of an alcohol solution containing nickel ions and a reducible chelating ligand having a hydrazone unit so as to form a gel film; and subjecting the resultant gel film to a heat treatment under an inert gas atmosphere.

4. The method of forming a nickel metal thin film according to claim 3, wherein said substrate is coated with said solution for forming a nickel metal thin film by a dip coating method or a spin coating method.

5. The method of forming a nickel metal thin film according to claim 3, wherein said heat treatment is performed at temperatures not lower than 400° C. for 10 to 30 minutes.

6. The method of forming a nickel metal thin film according to claim 3, wherein said substrate is an insulating substrate.

7. The method of forming a nickel metal thin film according to claim 4, wherein said heat treatment is performed at temperatures not lower than 400° C. for 10 to 30 minutes.

8. The method of forming a nickel metal thin film according to claim 4, wherein said substrate is an insulating substrate.

9. The method of forming a nickel metal thin film according to claim 7, wherein said substrate is an insulating substrate.

10. A method of forming a nickel metal thin film having a thickness of about 80 nm or less, comprising the steps of:

coating a substrate with a solution for forming a nickel metal thin film having a thickness of about 80 nm or less, said solution being formed of an alcohol solution containing nickel ions and a reducible chelating ligand having a hydrazone unit, said reducible chelating ligand being contained in an amount two times as much in the molar amount as said nickel ions, so as to form a gel film; and subjecting the resultant gel film to a heat treatment under an inert gas atmosphere.

11. The method of forming a nickel metal thin film according to claim 10, wherein said substrate is coated with said solution for forming a nickel metal thin film by a dip coating method or a spin coating method.

12. The method of forming a nickel metal thin film according to claim 10, wherein said heat treatment is performed at temperatures not lower than 400° C. for 10 to 30 minutes.

13. The method of forming a nickel metal thin film according to claim 10, wherein said substrate is an insulating substrate.

14. The method of forming a nickel metal thin film according to claim 11, wherein said heat treatment is performed at temperatures not lower than 400° C. for 10 to 30 minutes.

15. The method of forming a nickel metal thin film according to claim 11, wherein said substrate is an insulating substrate.

16. The method of forming a nickel metal thin film according to claim 14, wherein said substrate is an insulating substrate.

* * * * *